US006541766B2

(12) United States Patent
Kato

(10) Patent No.: US 6,541,766 B2
(45) Date of Patent: Apr. 1, 2003

(54) ION TRAP MASS SPECTROMETRY AND ION TRAP MASS SPECTROMETER

(75) Inventor: Yoshiaki Kato, Mito (JP)

(73) Assignee: Hitachi, Ltd., Tokyo (JP)

( * ) Notice: Subject to any disclaimer, the term of this patent is extended or adjusted under 35 U.S.C. 154(b) by 146 days.

(21) Appl. No.: 09/726,598

(22) Filed: Dec. 1, 2000

(65) Prior Publication Data

US 2001/0002696 A1 Jun. 7, 2001

(30) Foreign Application Priority Data

Dec. 2, 1999 (JP) ..... 11-342837

(51) Int. Cl.[7] ..... H01J 49/42

(52) U.S. Cl. ..... 250/282; 250/281; 250/292; 250/293

(58) Field of Search ..... 250/281, 282, 250/292, 293

(56) References Cited

U.S. PATENT DOCUMENTS

| | | | | | |
|---|---|---|---|---|---|
| 2,939,952 | A | | 6/1960 | Paul et al. | 250/41.9 |
| 4,540,884 | A | | 9/1985 | Stafford et al. | 250/282 |
| 4,736,101 | A | | 4/1988 | Syka et al. | 250/292 |
| 5,107,109 | A | * | 4/1992 | Stafford, Jr. et al. | 250/282 |
| 5,381,006 | A | | 1/1995 | Wells et al. | 250/282 |
| 5,625,186 | A | * | 4/1997 | Frankevich et al. | 250/292 |
| 5,640,011 | A | * | 6/1997 | Wells | 250/282 |
| 5,734,162 | A | * | 3/1998 | Dowell | 250/292 |
| 5,994,697 | A | | 11/1999 | Kato | 250/292 |

* cited by examiner

*Primary Examiner*—Bruce Anderson
*Assistant Examiner*—Nikita Wells
(74) *Attorney, Agent, or Firm*—McDermott, Will & Emery

(57) ABSTRACT

It is intended to prevent occurrence of random noise in an ion trap mass spectrometer with an electron impact (EI) ion source during mass analyzing. Specifically, two gates are placed between a filament and an end cap electrode. Positive or negative voltage is applied to the two electrodes in such a manner as to prevent both ions and electrons from entering an ion trap region in a mass analyzing step. This eliminates random noise on a mass spectrum, thereby allowing mass spectrum measurement of smaller quantities of components. It also eliminates noise on a chromatogram, thus allowing quantitative analysis of smaller quantities of components.

15 Claims, 5 Drawing Sheets

ION TRAP MASS SPECTROMETRY AND ION TRAP MASS SPECTROMETER

BACKGROUND OF THE INVENTION

1. Field of the Invention

The present invention relates to an ion trap mass spectrometry and an ion trap mass spectrometer.

2. Description of the Prior Art

Fundamental configuration and operation of an ion trap are disclosed in U.S. Pat. No. 2,939,952 by Paul et al.

In addition, mass spectrometers using ion traps are disclosed in Japanese Patent Laid-Open No. 59-134546, Japanese Patent Laid-Open No. 62-37861, Japanese Patent Laid-Open No. 7-146283, Japanese Patent Laid-Open No. 10-294078, and U.S. Pat. No. 5,734,162.

As disclosed in the above-mentioned publications, an ion trap mass spectrometer has a ring electrode and a pair of end cap electrodes, which form an ion trap region to trap ions.

Fundamental operation of an ion trap mass spectrometer with an electron impact (EI) ion source includes an ionization step in which a sample in an ion trap region is ionized by allowing it to collide with electrons, and resulting ions are accumulated in the ion trap region, and a mass analyzing step in which the accumulated ions are consecutively ejected from the ion trap region by scanning of radio frequency (Rf) voltage applied to the above-mentioned electrodes, and the ejected ions are detected by a detector. Thus, fundamental operation of mass analyzing is to go through each of the steps with the lapse of time.

In the mass analyzing step described above, there should not be new ionization, external ion injection, or the like in the ion trap region. If ionization or ion injection in the ion trap region occurs during mass analyzing, ions are ejected from the ion trap region to the outside regardless of their masses during main high frequency voltage scanning for mass analyzing. The ejected ions are detected by a detector. This results in random noise that appears on a mass spectrum.

For example, suppose that ions having a mass number of 200 and a mass number of 250 are generated in the ion trap region at the moment when a high frequency applied to the ring electrode is being scanned and thereby ions having a mass number of 300 are to be ejected. The ions having a mass number of 200 and a mass number of 250 immediately become unstable in the ion trap region due to a quadrupole Rf field in the ion trap region. The ions are immediately ejected from the ion trap region to the outside, resulting in noise before and after the mass number of 300 on a mass spectrum.

Thus, in an ion trap mass spectrometer, the ionization step and the mass analyzing step are strictly separated by controlling electrons by means of an electron gate so that occurrence of noise can be prevented.

In actuality, however, even with an ion trap mass spectrometer using the above-mentioned electron gate, spike noise occurs occasionally on a mass spectrum. FIG. 5B shows a mass spectrum when noise has occurred. In the figure, m3 denotes a molecular ion resulting directly from ionization of a sample molecule, while m1 and m2 denote fragment ions resulting from cleavage of the molecular ion. A spectrum to appear should include only m1 to m3, as shown in FIG. 5A; however, in actuality, many mass peaks other than m1, m2, and m3 appear, and thus a mass spectrum as shown in FIG. 5B is obtained. In the figure, noise is denoted by a symbol n written on top of a mass peak. Of course, n, m1, m2, and the like are not written on an obtained mass spectrum. As a result, it is impossible for the observer to distinguish between signals and noise. Some of the noise peaks result from ionization of background components other than sample components. These noise peaks are reproducible, and therefore distinguishable. In the case of high-sensitivity measurement in which very small quantities of components are measured, however, random noise appears in addition to the above noises. Since the noise is a random noise occurring irrespective of mass number, it is quite impossible to identify ions that cause the noise. Furthermore, the noise could make it impossible to perform high-sensitivity quantitative analysis. The noise may ruin the characteristic of an ion trap mass spectrometer of being highly sensitive.

SUMMARY OF THE INVENTION

An object of the present invention is to solve such problems and allow high-sensitivity measurement of an ion trap mass spectrometer.

Several factors can be considered as the causes of random noise; however, it has been found as a result of experiments by the inventor that the following are the two main causes of random noise.

(First Cause) Ions are injected into an ion trap region in the mass analyzing step.

As described above, in the mass analyzing step, an electron gate is closed (application of a negative voltage) so that electrons will not enter an ion trap region. However, in order to stabilize emitted electrons, a filament is supplied with a current from a filament power supply at all times. Therefore, in the vicinity of the tip of the filament, there exist in large numbers electrons emitted from the filament as well as electrons and other particles reflected from a grid electrode and the like. On the other hand, pressure around the periphery of the filament represents $10^{-3}$ Pa to $10^{-4}$ Pa, and thus many residual gases are present there. When the residual gases and electrons in the vicinity of the filament collide with each other, gaseous molecules are ionized to form positive ions. The positive ions are accelerated by a negative voltage applied to the electron gate electrode, and then enter the ion trap region. The ions are immediately ejected from the ion trap region and then detected by a detector, thereby resulting in random noise.

(Second Cause) Electrons, photons, and ions emitted from the filament directly enter the detector.

As a detector of a mass spectrometer, a detecting system using a secondary electron multiplier or a photomultiplier in which ions are converted into electrons to emit light by means of a scintillator is employed. In addition, not all the electrons and photons emitted from the filament enter the ion trap region; some are reflected in a diffused manner by a wall surface or the like inside the vacuum vessel that houses the mass spectrometer. Such electrons and photons directly enter the detector, thereby causing noise. Furthermore, accelerated electrons ionize residual gas molecules in the vacuum vessel on the way to the detector. When the resulting ions directly enter the detector, it also results in noise.

The present invention has been made to solve such problems. Specifically, an electron gate electrode situated between a filament and an end cap electrode is divided into two pieces, whereby voltages applied to the respective pieces are controlled independently of each other during ionization and during mass analyzing. This prevents undesired ions and electrons from being injected into an ion trap region during mass analyzing.

In addition, according to the present invention, a plurality of cylindrical or plate electrodes for shielding electrons, ions, and photons are disposed between the filament and a detector. This makes it possible to prevent ions, electrons, and other particles scattered in a vacuum vessel from directly entering the detector.

DETAILED DESCRIPTION OF THE INVENTION

First Embodiment

Figure 1:
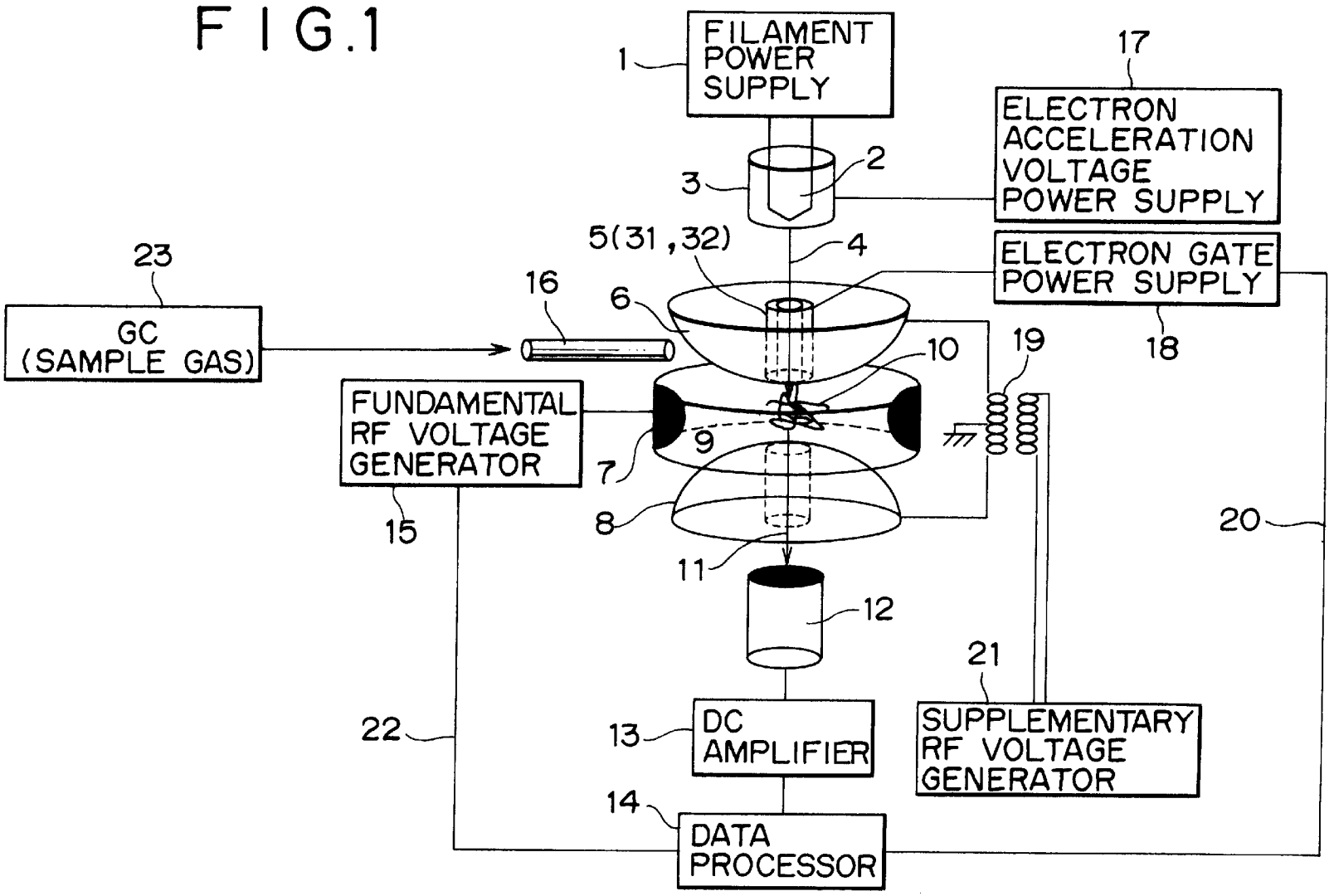
FIG. 1 is a schematic configuration diagram of the present invention.

A first embodiment of the present invention will be described with reference to FIGS. 1, 2, and 4.

First in FIG. 1, a schematic configuration of an ion trap mass spectrometer will be described. In order to form a region referred to as an ion accumulating region or an ion trap region 9, the ion trap mass spectrometer is provided with a ring electrode 7 having a hyperboloid of revolution and two end cap electrodes 6 and 8 each having a hyperboloid that adjoins the ring electrode 7 from the direction of its revolution axis. A region enclosed by these three electrodes is an ion trap region 9. A high frequency is applied between the ring electrode 7 and the two end cap electrodes 6 and 8 by a fundamental Rf voltage generator 15. As a result, a quadrupole high frequency field is created within the ion trap region 9, and thus ions having mass-to-charge ratios (m/z) in a specified range can be trapped therein.

In addition, a supplementary Rf at a voltage of about 0 to 10 V is applied by a supplementary Rf voltage generator 21 to the end cap electrodes 6 and 8 via a transformer 19. When the supplementary Rf is applied between the two end cap electrodes 6 and 8, a dipole field is generated within the ion trap region 9. This results in a state in which ions with specific mass-to-charge ratios (m/z) can resonate.

Furthermore, the ion trap mass spectrometer with an electron impact (EI) ion source includes a filament 2 which emits thermal electrons when heated by a current supplied from a filament power supply 1, a grid electrode 3 provided around the periphery of the filament 2, a cylindrical electron gate electrode 5, an electron gate power supply 18 that applies a specified voltage to the electron gate electrode 5, and a detector 12 that detects ions.

The fundamental Rf voltage generator 15, the supplementary Rf voltage generator 21, and the electron gate power supply 18 are controlled by a data processor 14 via signal lines 22 and 20.

Figure 2:
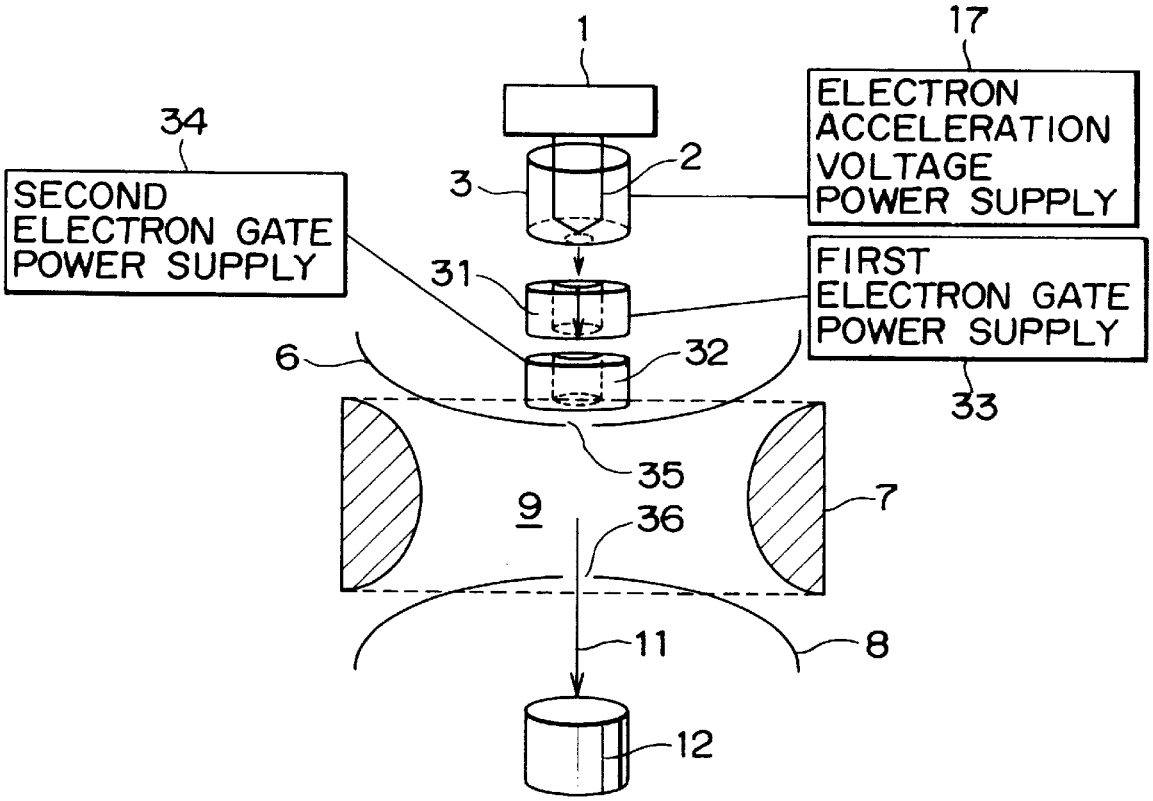
FIG. 2 is a configuration diagram showing a first embodiment of the present invention.

FIG. 2 shows detailed structure of the electron gate electrode 5 and its vicinity. The electron gate electrode 5 according to the present invention is divided into two pieces, which are shown as a first electron gate electrode 31 and a second electron gate electrode 32. Both of the electrodes are formed by a cylindrical metal. Also, the electron gate power supply 18 comprises two parts, that is, a first electron gate power supply 33 and a second electron gate power supply 34.

Operation of the ion trap mass spectrometer is divided into a few steps (modes) according to the lapse of time. Operation at each step will be described with reference to FIG. 4. Incidentally, one period in which one mass spectrum is obtained is about 0.1 seconds to a few seconds.

(1) Ionization (Ion Accumulation) Step

Figure 4:
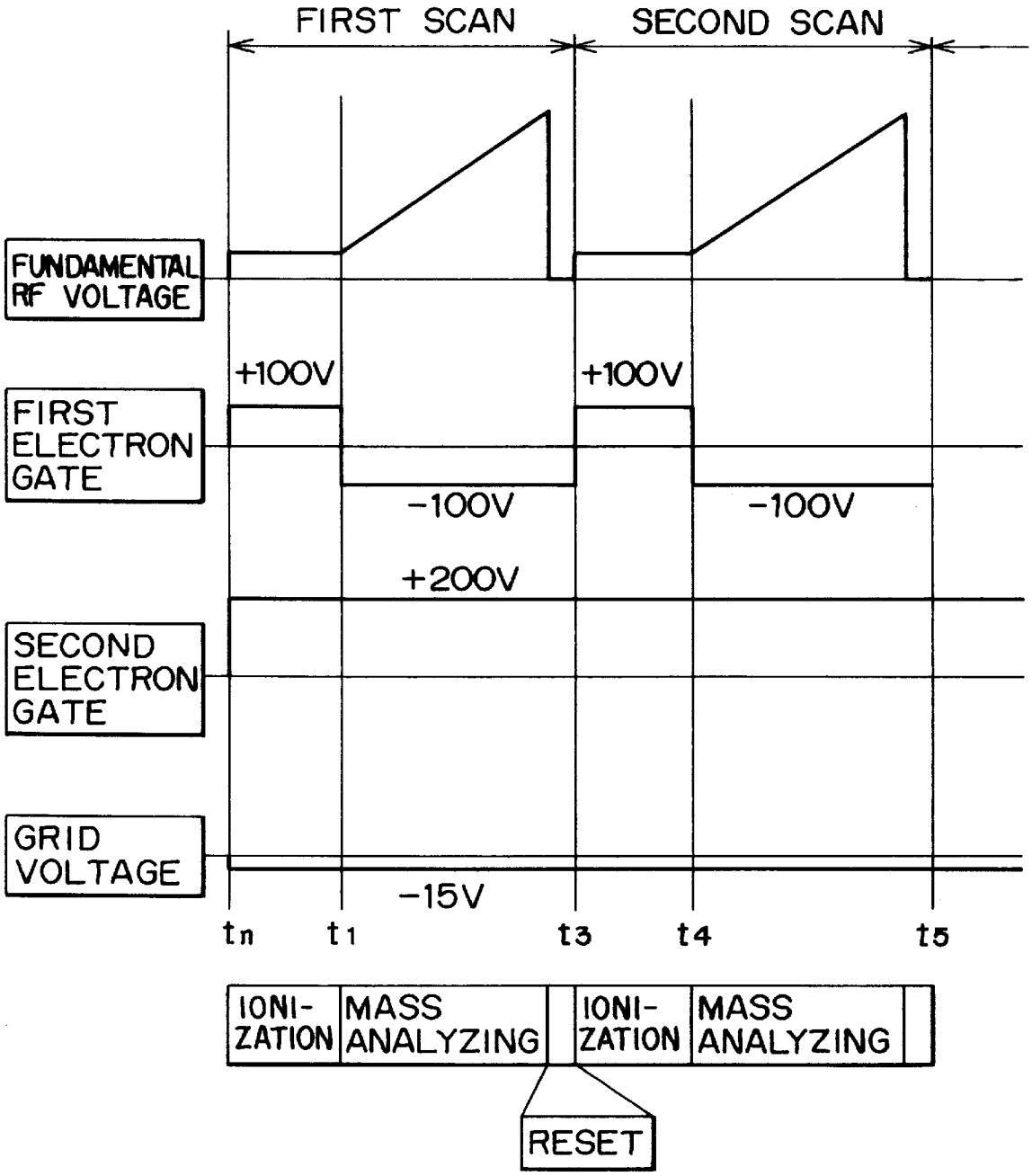
FIG. 4 is a diagram of assistance in explaining operation according to the present invention.
Figure 5A:
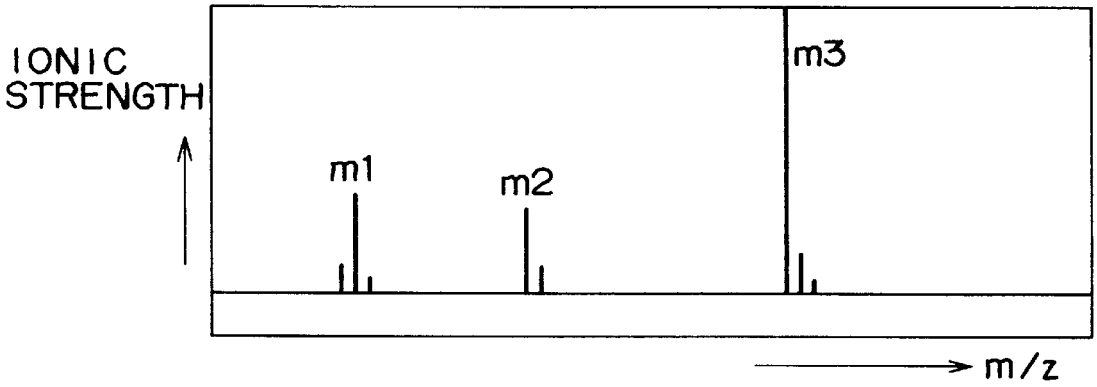
FIGS. 5A and 5B are mass spectrum diagrams of assistance in explaining a result of measurement by a conventional apparatus.
Figure 5B:
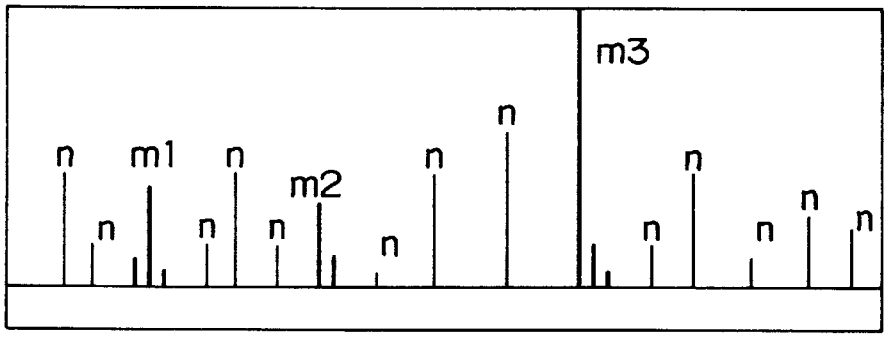

An interval corresponding to a period from $t_0$ to $t_1$ in FIG. 4 represents an ionization step.

First, the high frequency voltage to be applied from the fundamental Rf voltage generator 15 to the ring electrode 7 is set low so that ions with different masses can be simultaneously trapped in the ion trap region 9.

A voltage of −15 V supplied from an electron acceleration voltage power supply 17 is applied to the grid electrode 3, which surrounds the filament 2. A voltage supplied from the first electron gate power supply 33 is applied to the first electron gate electrode 31. The first electron gate power supply 33 is capable of applying voltages in a range of ±50 V to ±200 V to the first electron gate electrode 31. In this case, however, a voltage of +100 V is applied. A voltage supplied from the second electron gate power supply 34 is applied to the second electron gate electrode 32. The second electron gate power supply 34 is capable of applying voltages in a range of +100 V to +300 V to the second electron gate electrode 32. In this case, however, a voltage of +200 V is applied.

A thermal electron 4 emitted from the filament 2 is accelerated by the potentials of the grid electrode 3, the first electron gate electrode 31, and the second electron gate power supply 34, which potentials increase in the order named. Then, the thermal electron is injected into the ion trap region 9 through an aperture created at the center of the end cap electrode 6. At this point, the thermal electron collides with a sample gas injected through a sample gas guide pipe 16 from a gas chromatograph (GC) 23 or the like, thereby ionizing a sample gas molecule. The thus generated ion forms a stable ion trajectory 10 within the ion trap region 9, and then trapped therein. During the ionization (about 10 microseconds to 0.1 seconds), thermal electrons from the filament 2 are continuously injected into the ion trap region 9, and thus sample ionization or ion accumulation is continuously performed.

An interaction between an electron and a gas molecule may produce a positive ion in the periphery of the filament 2. If the positive ion is injected into the ion trap region 9, it is detected as a noise. However, the produced positive ion is accelerated in a direction opposite to the first electron gate electrode 31 due to a difference between the above-mentioned potentials of the first electron gate electrode 31 and the filament 2 (the filament 2 has substantially the same potential as that of the grid electrode 3). Eventually, the positive ion collides with the grid electrode 3 to lose its charge and vanish. Therefore, the positive ion will not be injected into the ion trap region 9.

It is also conceivable that in addition to a positive ion, a negative ion might be generated. Since a negative ion has the same polarity as that of an electron, it might cause interference. However, the probability of negative ion generation at a pressure of about $10^{-3}$ Pa is low at about $1/10^3$ to $1/10^4$ as compared with positive ions, which is substantially negligible. As a result, there is no fear of noise even if a negative ion produced is injected into the ion trap region 9 together with an electron.

(2) Mass Analyzing Step

As shown in FIG. 4, when the ionization period ends at a time $t_1$, the operation of the ion trap mass spectrometer proceeds to the next mass analyzing step. At this step, a negative voltage is applied to the first electron gate electrode 31. In this case, a voltage of −100 V is applied. Because of this potential setting, a thermal electron 4 emitted from the filament 2 is not accelerated. Thus, the thermal electron cannot pass through the first electron gate electrode 31 and therefore will not enter the ion trap region 9. Incidentally, the voltages applied to the second electron gate electrode 32 and the grid electrode 3 are not changed from the values at the ionization step and remain constant. In this case, voltages of +200 V and −15 V continue to be applied to the second electron gate electrode 32 and the grid electrode 3, respectively.

In the meantime, the data processor 14 controls the fundamental Rf voltage generator 15 to begin scanning of Rf voltage applied to the ring electrode 7. As a result, trapped ions consecutively become unstable, and are then ejected to the outside of the ion trap region 9 through an aperture of the end cap electrode 8. The ejected ions 11 are detected by the detector 12. A signal resulting from the detection is amplified by a DC amplifier 13 and sent to the data processor 14 to provide a mass spectrum.

The filament 2 continues to emit thermal electrons continuously in the mass analyzing step. Therefore, an interaction between an electron and a surrounding gas produces a positive ion in the proximity of the filament 2. Since a negative voltage is applied to the first electron gate electrode 31 to block electrons, the resulting positive ion is accelerated in the direction of the first electron gate electrode. According to the present invention, however, a positive voltage is applied to the second electron gate electrode 32. This means that the positive ion that has passed through the first electron gate electrode 31 is unable to pass through the second electron gate electrode 32 because of a potential difference between the first electron gate electrode 31 and the second electron gate electrode 32. This makes it possible to prevent positive ions from entering the ion trap region 9 also in the mass analyzing step.

(3) Reset

After a mass spectrum is obtained, the high frequency voltage applied to the ring electrode 7 is reset at zero. As a result, ions with large masses remaining in the ion trap region 9 are all ejected to the outside of the ion trap region, or collide with a wall in the ion trap region and thereby lose their charge.

One mass spectrum is obtained by the operations (1) to (3) (completion of a first scan). Then, the operations (1) to (3) are repeated to collect a plurality of mass spectra consecutively.

As described above, according to the present invention, control of electrons and ions that cause noise is made possible by controlling voltages applied to the first electron gate electrode and the second electron gate electrode in such a manner as to accelerate electrons into the ion trap region 9 and remove produced positive ions in the ionization step, and by controlling voltages applied to the first electron gate electrode and the second electron gate electrode in such a manner as to remove electrons at the first electron gate electrode 31 and remove positive ions at the second electron gate electrode 32 in the mass analyzing step. Specifically, it is possible to inject only electrons into the ion trap region 9 in the ionization step and block both electrons and positive ions in the mass analyzing step. Thus, it is possible to suppress and eliminate occurrence of random noise in mass analyzing.

Incidentally, U.S. Pat. No. 5,734,162 mentioned above discloses two electron gate electrodes, and therefore is similar to the present invention in structure. However, according to U.S. Pat. No. 5,734,162, the same power supply is connected to the two electron gate electrodes, and therefore the function of those electron gates is considered to be the same as that of a single electron gate. There has been no disclosure regarding independent control of a voltage applied to each individual electron gate electrode, as disclosed in the present invention. Elimination of random noise is achieved only by controlling voltages applied to the two electron gate electrodes independently of each other at each of the ionization step and the mass analyzing step, as disclosed in the present invention.

In this example, the first electron gate electrode and the second electron gate electrode are disclosed as cylindrical metallic electrodes. In addition to these electrodes, disc-shaped metallic electrodes having apertures created at the center to allow passage of electrons may be used. Metallic meshes and the like may also be used.

Second Embodiment

Figure 3:
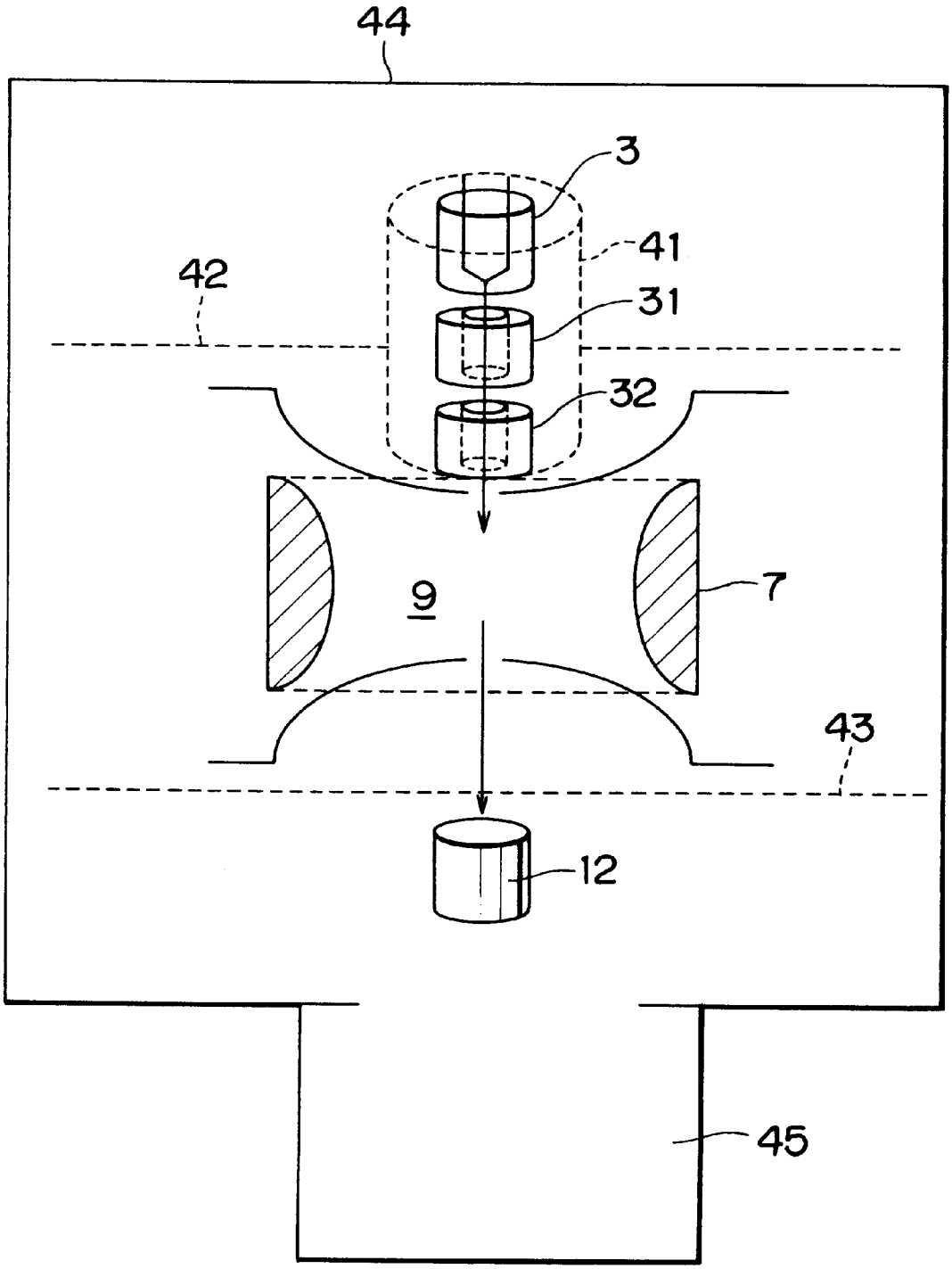
FIG. 3 is a configuration diagram showing a second embodiment of the present invention.

FIG. 3 is a detailed diagram of a second embodiment of the present invention. The second embodiment is intended to reduce noise by preventing electrons, photons, and ions that are generated in the proximity of a filament 2 and may cause noise from directly entering a detector 12.

The ion trap mass spectrometer is placed within a vacuum vessel 44 evacuated by a turbo-molecular pump 45. Around the periphery of the filament 2, a first electron gate electrode 31, and a second electron gate electrode 32, there exist in large numbers electrons and photons emitted from the filament 2 and accelerated, secondary electrons resulting from collision of electrons with electrode surfaces, and ions generated by reaction with surrounding gases. If even a fraction of the particles enter the detector 12, it results in random noise.

In the second embodiment, in order to block the charged particles and photons, the periphery of the filament 2, the first electron gate electrode 31, and the second electron gate electrode 32 is covered with a shield electrode 41. The shield electrode 41 is set at ground potential so that it will not be charged up when ions or other particles collide with it.

For the blocking of charged particles and photons, a metallic plate without apertures is effective as the shield electrode 41. However, it prevents pressure around the periphery of the filament 2 from being maintained at a low level. In order to lengthen the life of the filament 2 and also to prevent electrodes in the proximity of the filament 2 from being contaminated, it is necessary to lower the pressure around the periphery of the filament as much as possible. In order to achieve this, evacuation conductance needs to be maintained at a high level. Thus, a metallic plate with multiple apertures or a metallic mesh is suitable as the shield electrode 41.

In addition, it is conceivable that electrons and other particles may pass through the shield electrode 41. Therefore, plate shield electrodes 42 and 43 are provided to trap the electrons and other particles that have passed through the shield electrode 41. The shield electrodes 42 and 43 are placed around the end cap electrodes 6 and 8. This is because the end cap electrodes 6 and 8 operate approximately at ground potential while a ring electrode 7 is supplied with a high frequency potential of nearly 20 kV (peak to peak), and therefore it is not desirable to bring the shield electrodes at ground potential close to the ring electrode. The shield electrodes 42 and 43 may be metallic plates or meshes. Also, it is possible to combine two mesh plates so that the trapping of charged particles is performed efficiently while maintaining the evacuation conductance at a certain level.

It is possible to combine the first embodiment with the second embodiment. A structure resulting from such combination is one as shown in FIG. 3. The control of the two electron gate electrodes as described in the first embodiment and the effects of the shield electrodes as described in the second embodiment better ensure prevention of entry of undesired electrons and other particles into the detector, thus making it possible to further reduce the possibility of occurrence of random noise.

As described above, according to the present invention, random noise in mass analyzing is reduced, and therefore mass spectra of smaller quantities of components can be obtained with high sensitivity. Also, mass spectrum analysis will not be interfered with by noise. Furthermore, total ion chromatogram (TIC) noise is also reduced, thereby making it possible to perform high-sensitivity quantitative analysis of smaller quantities of components.

What is claimed is:

1. A method of mass spectrometry using an ion trap mass spectrometer, said ion trap mass spectrometer including: a filament for emitting electrons; a ring electrode and a pair of end cap electrodes for forming an ion trap region; a first electron gate electrode and a second electron gate electrode provided between said filament and one of the end cap electrodes; and a detector for detecting an ion ejected from said ion trap region, said method of mass spectrometry comprising:

ionizing a sample, the ionizing step comprising applying a positive voltage to said first electron gate electrode and said second electron gate electrode to inject electrons from the filament into said ion trap region; and analyzing mass of the ionized sample, the analyzing step comprising: applying a negative voltage to said first electron gate electrode, applying a positive voltage to said second electron gate electrode, and scanning a high frequency voltage applied to said ring electrode, whereby ions in said ion trap region are consecutively ejected and then detected.

2. A method of mass spectrometry as claimed in claim 1, wherein in said ionizing step, a voltage applied to the second electron gate electrode is higher than that of the first electron gate electrode.

3. A method of mass spectrometry as claimed in claim 1, wherein in said analyzing step, the absolute value of a voltage applied to the second electron gate electrode is higher than that of the first electron gate electrode.

4. An ion trap type mass spectrometer for performing mass analysis by ionizing a sample injected into an ion trap region using electrons emitted from a filament and obtaining a mass spectrum by detecting ions ejected from the ion trap region using a detector, comprising:

a first electron gate electrode and a second electron gate electrode disposed between the filament and an end cap electrode; and an application voltage control unit for effecting control in such a manner as to apply positive voltage to said first electron gate electrode and said second electron gate electrode during ionization and to apply a negative voltage to said first electron gate electrode and a positive voltage to said second electron gate electrode during mass analyzing.

5. An ion trap type mass spectrometer as in claim 4, further comprising a shield electrode surrounding the first and second electron gate electrodes.

6. An ion trap type mass spectrometer as in claim 5, wherein during operations of the ion trap type mass spectrometer, voltage on the shield electrode is set to ground.

7. An ion trap type mass spectrometer as in claim 5, wherein the shield electrode comprises a metal cylinder with a plurality of apertures or a cylindrical metallic mesh.

8. An ion trap type mass spectrometer as in claim 4, further comprising a pair of shield plate electrodes.

9. An ion trap type mass spectrometer as in claim 8, wherein each of the shield plate electrodes comprises a metal plate or a metallic mesh.

10. An ion trap type mass spectrometer for performing mass analysis, the spectrometer comprising:

a filament for emitting electrons;

at least one electrode forming an ion trap region, for trapping ions formed by impacting of one or more of the electrons from the filament on one or more molecules of a sample;

first and second electron gate electrodes, disposed along an electron path between the filament and the ion trap;

at least one gate power supply coupled to the first and second electron gate electrodes; and an ion detector, positioned to detect ions emerging from the ion trap region, wherein:

during a sample ionization operation, the at least one gate power supply applies a positive voltage to the first electron gate electrode and applies a positive voltage to the second electron gate electrode, and during a mass analysis operation, the at least one gate power supply applies a negative voltage to the first electron gate electrode and applies a positive voltage to the second electron gate electrode.

11. An ion trap type mass spectrometer as in claim 10, further comprising a processor for controlling selective application of the voltages to the first and second electron gate electrodes by the at least one gate power supply during distinct times for the sample ionization operation and the mass analysis operation.

12. An ion trap type mass spectrometer as in claim 10, wherein the at least one electrode forming the ion trap region comprises a pair of end cap electrodes, and a ring electrode disposed between the end cap electrodes and around the ion trap region.

13. An ion trap type mass spectrometer as in claim 12, further comprising a high frequency power supply, for applying a high frequency voltage to the ring electrode and for scanning the high frequency voltage applied to the ring electrode so as to cause ejection of ions from the ion trap region during the mass analysis operation.

14. An ion trap type mass spectrometer as in claim 10, further comprising a shield electrode surrounding the filament and the first and second electron gate electrodes.

15. An ion trap type mass spectrometer as in claim 10, further comprising a pair of shield plate electrodes, each of the shield plate electrodes being disposed proximate one of the end cap electrodes.

* * * * *